US007202600B2

(12) United States Patent
Zovko et al.

(10) Patent No.: US 7,202,600 B2
(45) Date of Patent: Apr. 10, 2007

(54) DIMENSIONALLY STABLE ELECTROLUMINESCENT LAMP WITHOUT SUBSTRATE

(75) Inventors: Charles I. Zovko, Chandler, AZ (US); P. Kevin Sysak, Phoenix, AZ (US)

(73) Assignee: World Properties, Inc., Lincolnwood, IL (US)

( * ) Notice: Subject to any disclaimer, the term of this patent is extended or adjusted under 35 U.S.C. 154(b) by 318 days.

(21) Appl. No.: 10/790,978

(22) Filed: Mar. 2, 2004

(65) Prior Publication Data

US 2005/0194895 A1 Sep. 8, 2005

(51) Int. Cl.
*H01J 1/62* (2006.01)
*H01J 63/04* (2006.01)

(52) U.S. Cl. ..... 313/506; 313/504; 313/512

(58) Field of Classification Search ..... 313/498, 313/503, 504, 506, 509, 512; 428/690
See application file for complete search history.

(56) References Cited

U.S. PATENT DOCUMENTS 5,565,733 A 10/1996 Krafcik et al. ..... 313/510
5,770,920 A * 6/1998 Eckersley et al. ..... 313/506
5,780,965 A 7/1998 Cass et al. ..... 313/506
5,856,030 A 1/1999 Burrows ..... 428/690
5,882,806 A * 3/1999 Mori ..... 428/690
6,198,216 B1 * 3/2001 Kosa et al. ..... 313/503
6,413,676 B1 * 7/2002 Munshi ..... 429/306
6,445,128 B1 9/2002 Bush et al. ..... 313/509
6,503,432 B1 * 1/2003 Barton et al. ..... 264/173.16
6,749,650 B2 * 6/2004 Gonzalez et al. ..... 29/623.5
6,771,019 B1 * 8/2004 Wu et al. ..... 313/503
6,787,993 B2 * 9/2004 Bush et al. ..... 313/509
2004/0145089 A1 * 7/2004 Burrows ..... 264/496

FOREIGN PATENT DOCUMENTS

WO WO 02/103718 12/2002

* cited by examiner

*Primary Examiner*—Nimeshkumar D. Patel
*Assistant Examiner*—Kevin Quarterman
(74) *Attorney, Agent, or Firm*—Paul F. Wille

(57) ABSTRACT

An electroluminescent panel includes a release layer, a first insulating layer on the release layer, a plurality of lamp layers on the first insulating layer, and a second insulating layer overlying the lamp layers. In accordance with one aspect of the invention, the first insulating layer and the second insulating layer include low molecular weight PVDF/HFP resin. In accordance with another aspect of the invention, at least one of the lamp layers includes a UV-cured resin and the remaining lamp layers include a heat-cured resin.

13 Claims, 4 Drawing Sheets

| Type | Front Insulator | Color Cascading Layer | Front Electrode | Phosphor Type | Dielectric Type | Rear Electrode | Front Busbar | Middle Insulator | Third Electrode | Rear Busbar | Rear Insulator |
|---|---|---|---|---|---|---|---|---|---|---|---|
| 1 | FI-A | White 1 | OR 3040 | Phos. 1 | DE-A | OR 4010 | Ag Dur | Insul. 1 | OR 4010 | Ag Dur | Insul. 1 |
| 2 | FI-A | White 2 | OR 3040 | Phos. 2 | DE-A | OR 4010 | Ach 479SS | Insul. 2 | OR 4010 | SI107 | Insul. 2 |
| 3 | FI-A | White 3 | OR 3040 | Phos. 3 | DE-A | OR 4010 | Ag Dur | Insul. 3 | OR 4010 | Ach 479SS | Insul. 3 |
| 4 | FI-A | | OR 3040 | Phos. 1 | DE-A | OR 4010 | Ach 479SS | Insul. 1 | OR 4010 | Ag Dur | Insul. 1 |
| 5 | FI-A | | OR 3040 | Phos. 2 | DE-A | OR 4010 | Ag Dur | Insul. 2 | OR 4010 | SI107 | Insul. 2 |
| 6 | FI-A | | OR 3040 | Phos. 3 | DE-A | OR 4010 | Ach 479SS | Insul. 3 | OR 4010 | Ach 479SS | Insul. 3 |
| 7 | FI-A | White | OR 3040 | Phos. 1 | DE-A | OR 4010 | Ag Dur | | | | Insul. 1 |
| 8 | FI-A | | OR 3040 | Phos. 1 | DE-A | OR 4010 | Ach 479SS | | | | Insul. 3 |

Types 1 - 6 have three electrodes; types 7 and 8 have two electrodes. Other combinations can be used.
Red and green cascading color layers omitted in these types for simplicity.

FIG. 8

DIMENSIONALLY STABLE ELECTROLUMINESCENT LAMP WITHOUT SUBSTRATE

BACKGROUND OF THE INVENTION

This invention relates to a thick-film, inorganic, electroluminescent (EL) panel and, in particular, to an EL panel assembled on a release layer and, after separation from the release layer, an EL panel that does not substantially curl or distort.

As used herein, and as understood by those of skill in the art, "thick-film" refers to one type of EL lamp and "thin-film" refers to another type of EL lamp. The terms only broadly relate to actual thickness and actually identify distinct disciplines. In general, thin film EL lamps are made by vacuum deposition of the various layers, usually on a glass substrate or on a preceding layer. Thick-film EL lamps are generally made by depositing layers of inks on a substrate, e.g. by roll coating, spraying, or various printing techniques. The techniques for depositing ink are not exclusive, although the several lamp layers are typically deposited in the same manner, e.g. by screen printing. A thin, thick-film EL lamp is not a contradiction in terms and such a lamp is considerably thicker than a thin film EL lamp.

In the context of a thick-film EL lamp, and as understood by those of skill in the art, "inorganic" refers to a crystalline, luminescent material that does not contain silicon or gallium. The term does not refer to the other materials from which an EL lamp is made.

As used herein, an EL "panel" is a single sheet including one or more luminous areas, wherein each luminous area is an EL "lamp." An EL lamp is essentially a capacitor having a dielectric layer between two conductive electrodes, one of which is transparent. The dielectric layer can include phosphor particles or there can be a separate layer of phosphor particles adjacent the dielectric layer. The phosphor particles radiate light in the presence of a strong electric field, using relatively little current.

EL phosphor particles are typically zinc sulfide-based materials, including one or more compounds such as copper sulfide ($Cu_2S$), zinc selenide (ZnSe), and cadmium sulfide (CdS) in solid solution within the zinc sulfide crystal structure or as second phases or domains within the particle structure. EL phosphors typically contain moderate amounts of other materials such as dopants, e.g., bromine, chlorine, manganese, silver, etc., as color centers, as activators, or to modify defects in the particle lattice to modify properties of the phosphor as desired. The color of the emitted light is determined by the doping levels. Although understood in principle, the luminance of an EL phosphor particle is not understood in detail. The luminance of the phosphor degrades with time and usage, more so if the phosphor is exposed to moisture or high frequency (greater than 1,000 hertz) alternating current.

Various colors can be produced by mixing phosphors having different dopants or by "color cascading" phosphors. A copper-activated zinc sulfide phosphor produces blue and green light under an applied electric field and a copper/manganese-activated zinc sulfide produces orange light under an applied electric field. Together, the phosphors produce what appears to be white light. It has long been known in the art to color-cascade phosphors, i.e. to use the light emitted by one phosphor to stimulate another phosphor or other material to emit light at a longer wavelength; e.g. see U.S. Pat. No. 3,052,810 (Mash). It is also known to doubly cascade light-emitting materials. U.S. Pat. No. 6,023, 371 (Onitsuka et al.) discloses an EL lamp that emits blue light coated with a layer containing fluorescent dye and fluorescent pigment. In one example, the pigment absorbs blue light and emits green light, while the dye absorbs green light and emits red light.

A modern (post-1985) EL lamp typically includes transparent substrate of polyester or polycarbonate material having a thickness of about 7.0 mils (0.178 mm.). A transparent, front electrode of indium tin oxide or indium oxide is vacuum deposited onto the substrate to a thickness of 1000 Å or so. A phosphor layer is screen printed over the front electrode and a dielectric layer is screen printed over phosphor layer. A rear electrode is screen printed over the dielectric layer. It is also known in the art to deposit the layers by roll coating.

The inks used include a binder, a solvent, and a filler, wherein the filler determines the nature of the ink. A typical solvent is dimethylacetamide (DMAC). The binder is typically a fluoropolymer such as polyvinylidene fluoride/hexafluoropropylene (PVDF/HFP), polyester, vinyl, epoxy, or Kynar 9301, a proprietary terpolymer sold by Atofina. A phosphor layer is typically screen printed from a slurry containing a solvent, a binder, and zinc sulphide particles. A dielectric layer is typically screen printed from a slurry containing a solvent, a binder, and particles of titania ($TiO_2$) or barium titanate ($BaTiO_3$). A rear (opaque) electrode is typically screen printed from a slurry containing a solvent, a binder, and conductive particles such as silver or carbon.

As long known in the art, having the solvent and binder for each layer be chemically the same or chemically similar provides chemical compatibility and good adhesion between adjacent layers; e.g., see U.S. Pat. No. 4,816,717 (Harper et al.). It is not easy to find chemically compatible phosphors, dyes, binders, fillers, solvents or carriers and to produce, after curing, the desired physical properties, such as flexibility, and the desired optical properties, such as color and brightness.

An EL lamp constructed in accordance with the prior art is relatively stiff, even though it is typically only seven mils thick, making the lamp unsuited to some applications requiring greater flexibility, such as keypads. Layer thickness and stiffness are not directly related. The material from which the layer is made affects stiffness. Typically, EL lamps are made from the materials listed above. An EL lamp backlighting a keypad, for example, typically has holes under the keys to avoid affecting the actuation of a key. Simply reducing the thickness of the substrate does not provide the desired flexibility.

Relatively flexible EL lamps are known in the art. U.S. Pat. No. 5,856,030 (Burrows) discloses an EL lamp made on a UV-cured urethane layer on a release paper. The release paper provides substantial structural support while the lamp layers are applied from an ink containing a vinyl gel. Unlike panels made on substrates that are seven mils thick, or so, EL panels made on thin sheets from flexible materials, e.g. urethane one to five mils thick, do not keep their shape but bend or curl. This makes it extremely difficult to automate the assembly of panels into end products, e.g. a keypad for a cellular telephone or as the luminous structure in a three dimensional molded object.

Published PCT application WO 02/103718 alludes to "selected" layers of an EL structure being made from UV-curable inks. No basis for selection is described nor is any layer described that is not made from a UV-curable ink. U.S. Pat. No. 5,565,733 (Krafcik et al.) discloses an EL lamp made from solvent based materials and including a UV-curable dielectric layer overlying portions of conductive traces that are not connection points for the EL lamp. U.S. Pat. No. 5,770,920 (Eckersley et al.) discloses a UV-curable insulating layer overlying the rear electrode of an EL lamp made with solvent based materials. U.S. Pat. No. 5,780,965 (Cass et al.) discloses a polyurethane acrylic protective layer for an EL lamp. In general, the industry has followed the layers-having-similar-chemistry maxim pronounced in the Harper et al. patent, particularly for the lamp layers (between and including the electrodes).

In view of the foregoing, it is therefore an object of the invention to provide a thin, thick-film, inorganic EL panel that does not curl or distort when removed from a release layer.

Another object of the invention to provide a flexible EL lamp that is more stable dimensionally than urethane based EL lamps of the prior art.

A further object of the invention is to provide a flexible EL lamp that does not require similar chemistry for adjacent lamp layers.

Another object of the invention is to provide an EL lamp made from solvent based inks on a removable substrate or release layer.

A further object of the invention is to provide a flexible EL lamp that is brighter than flexible EL lamps of the prior art.

Another object of the invention is to provide a flexible EL lamp suitable for keypads.

SUMMARY OF THE INVENTION

The foregoing objects are achieved in this invention in which an electroluminescent panel includes a release layer, a first insulating layer on the release layer, a plurality of lamp layers on the first insulating layer, and a second insulating layer overlying the lamp layers. In accordance with a first aspect of the invention, the first insulating layer and the second insulating layer include low molecular weight PVDF/HFP resin. In accordance with a second aspect of the invention, at least one of the lamp layers includes a UV-cured resin and the remaining lamp layers include a heat cured resin.

BRIEF DESCRIPTION OF THE DRAWINGS

A more complete understanding of the invention can be obtained by considering the following detailed description in conjunction with the accompanying drawings, in which:

FIG. 8 is a table showing several combinations of materials suitable for making flexible EL lamps in accordance with the invention;

DETAILED DESCRIPTION OF THE INVENTION

Figure 1:
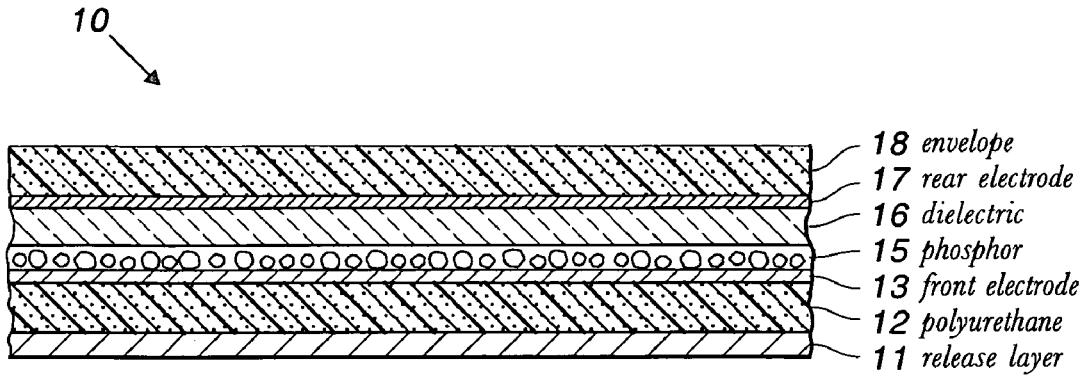
FIG. 1 (PRIOR ART)
FIG. 1 is a cross-section of an EL lamp constructed in accordance with the prior art.

FIG. 1 is a cross-section of an EL lamp constructed in accordance with the prior art. The various layers are not shown in proportion. In lamp 10, release film 11 supports UV-cured polyurethane envelope layer 12. Transparent front electrode 13 overlies layer 12 and is a layer of indium tin oxide powder in a vinyl gel. Phosphor layer 15 overlies the front electrode and dielectric layer 16 overlies the phosphor layer. Layers 15 and 16 are combined in some applications. Overlying dielectric layer 16 is opaque rear electrode 17. Envelope layer 18 seals lamp 10 about the periphery thereof (not shown). None of the layers is drawn to scale. Layer 18, for example, is about 1 mil. (0.025 mm) thick, as are the phosphor layer and the dielectric layer.

Figure 2:
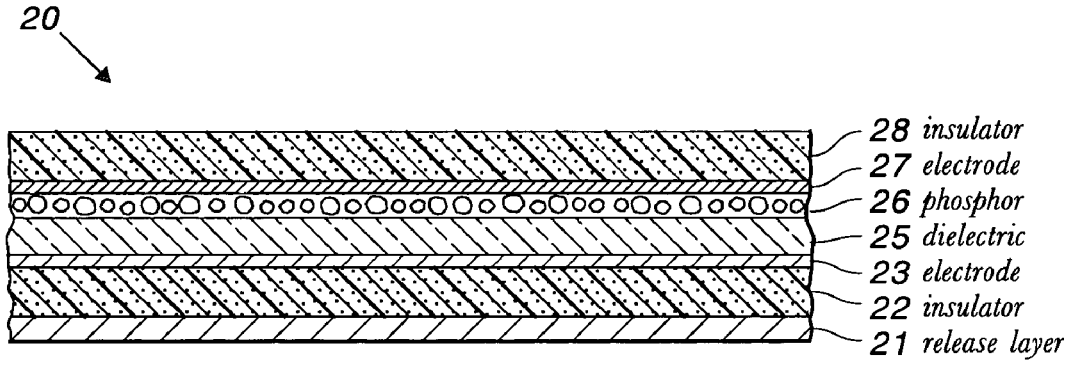
FIG. 2 is a cross-section of an EL lamp constructed in accordance with a preferred embodiment of the invention.

FIG. 2 is a cross-section of an EL lamp constructed in accordance with a preferred embodiment of the invention. Lamp 20 includes release layer 21 with insulating layer 22 deposited thereon, e.g. by screen printing or other technique known in the art. It is an advantage of the invention that known techniques can be used for making the EL lamp. The release layer is a coated paper or a plastic sheet, such as polyethylene terephthalate (PET), supplied in rolls, which facilitates handling the lamps and integrating the lamps into appliances or molding apparatus.

Electrode 23 is carbon/PEDOT/PSS (Poly-3,4-ethylenedioxythiophene/polystyrenesulfonic acid) (Orgacon™ EL-P 4010; Agfa-Gevaert N.V.), a conductive polymer composite that is screen printed on layer 22. Dielectric layer 25 overlies electrode 23 and phosphor layer 26 overlies the dielectric layer. Electrode 27 is made by screen printing a transparent PEDOT/PSS ink (Orgacon™ EL-P 3040; Agfa-Gevaert, N.V.) on phosphor layer 26. Electrode layers 23 and 27 can be patterned to define lit areas of the lamp in a graphic design. Insulating layer 28 overlies electrode 27.

Figure 3:
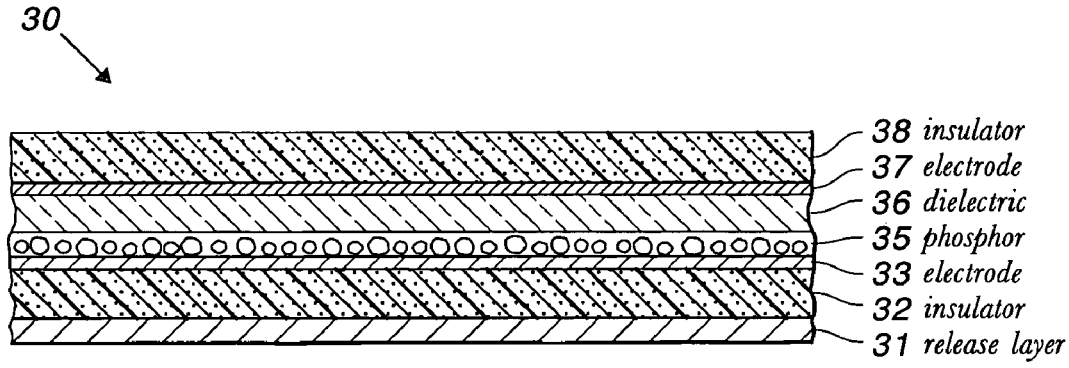
FIG. 3 is a cross-section of an EL lamp constructed in accordance with an alternative embodiment of the invention.

FIG. 3 is a cross-section of an EL lamp constructed in accordance with an alternative embodiment of the invention. Lamp 30 includes release layer 31 with insulating layer 32 deposited thereon. Electrode 33 is a PEDOT/PSS transparent conductive ink screen printed on layer 32. Phosphor layer 35 overlies electrode 33 and dielectric layer 36 overlies the phosphor layer. Electrode 37 overlies phosphor layer 36. Insulating layer 38 overlies electrode 37. Electrode layers 33 and 37 can be patterned.

The embodiments of FIGS. 2 and 3 differ in the positions of the phosphor layer and the dielectric layer. The embodiment of FIG. 2 emits more light upward than the embodiment of FIG. 3 because the phosphor layer is adjacent to a transparent electrode and the dielectric layer tends to reflect light from the phosphor layer through the transparent electrode. Conversely, the embodiment of FIG. 3 emits more light downward than the embodiment of FIG. 2.

Other layers could be added to the embodiment shown in FIGS. 2 and 3, such as graphic overlays and protective layers. Any layer can be split to form a plurality of lamps in a single panel.

In accordance with one aspect of the invention, materials have been found that enable one to make bright, flexible, long-life, thin, thick-film EL lamps with adjacent UV-curable and heat-curable (solvent based) layers. In one embodiment of the invention, referring to FIG. 2, an EL lamp was made in which layers 22 and 28 were UV-curable resin (Lustercure Special Coat C; Kolorcure Corp.) and the remaining layers were screen printed from ink containing fluoropolymer and solvent.

EXAMPLE 1

By way of example only, the following data describes the construction of an EL lamp in accordance with the invention. References are to FIG. 3.

Layer 31 polyester release layer; e.g. Burkhardt/Freeman Inc. 5-mil PET Sil C15-1806;

Layer 32 front insulator, for example, Kolorcure Lustercure Special Release Liner C;

Layer 33 front electrode; transparent PEDOT/PSS conductor, for example, Orgacon™ EL-P 3040;

Layer 35 phosphor layer; fluoropolymer resin;

Layer 36 dielectric layer; fluoropolymer resin, titania or barium titanate;

Layer 37 rear electrode; carbon/PEDOT/PSS conductor, for example, Orgacon™ EL-P 4010;

Layer 38 rear insulator, for example, Kolorcure Lustercure Special Release Liner C.

Figure 4:
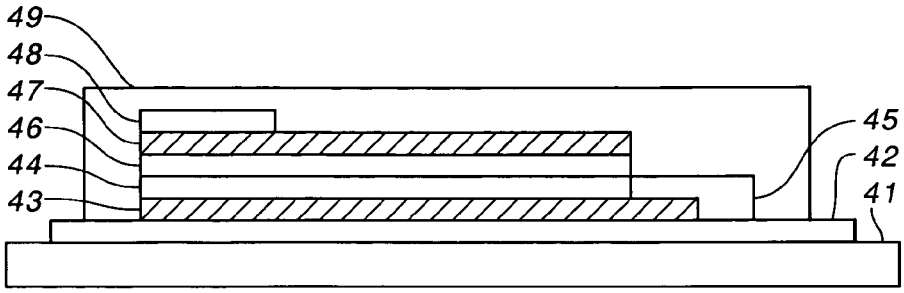
FIG. 4 is a cross-section of an EL lamp constructed in accordance with a preferred embodiment of the invention.

FIGS. 4–7 illustrate lamps constructed in accordance with a preferred embodiment of the invention. FIG. 4 illustrates the basic lamp, including: release layer 41, front insulator 42, front electrode 43, phosphor layer 44, front bus bar 45, dielectric layer 46, rear electrode 47, rear bus bar 48, and rear insulator 49.

Figure 5:
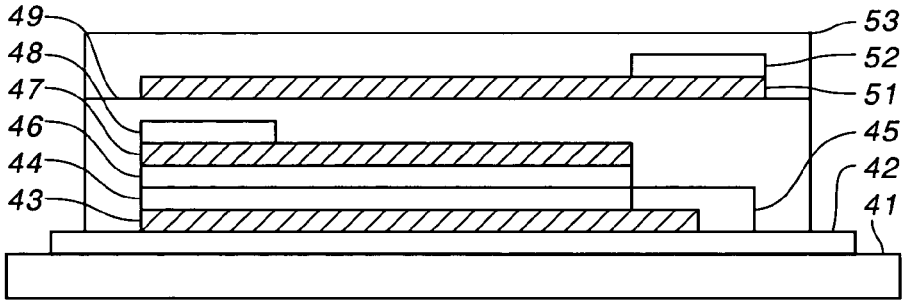
FIG. 5 is a cross-section of an EL lamp constructed in accordance with a preferred embodiment of the invention and having a third electrode.

In FIG. 5, third electrode 51 is added to reduce electric field effects, such as EMI (electromagnetic interference) and acoustic noise. Electrode 51 is coupled to a suitable source of power (not shown), or electrical ground, by bus bar 52. Insulating layer 53 overlies electrode 51 and bus bar 52.

Figure 6:
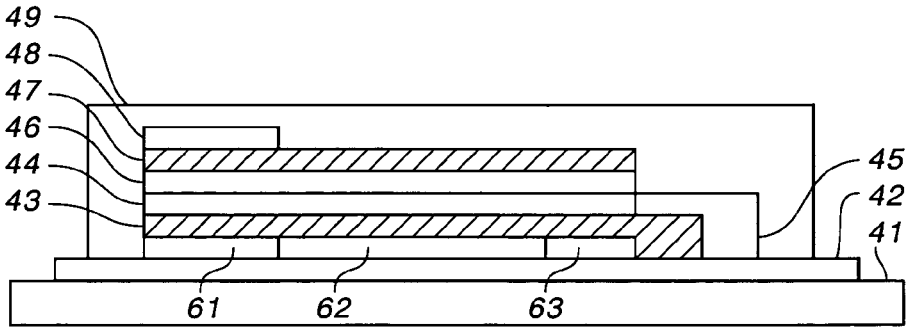
FIG. 6 is a cross-section of an EL lamp constructed in accordance with a preferred embodiment of the invention and including cascading layers.

In FIG. 6, a color-cascading layer is added. As illustrated, the layer includes three regions of different colors. A single color or any number of colors could be used. This embodiment is what can be used, for example, for backlighting the keypad in a cellular telephone, where several colors are desirable in addition to the basic color provided by phosphor layer 44. For example, the cascading layer includes red region 61, white region 62, and green region 63.

Figure 7:
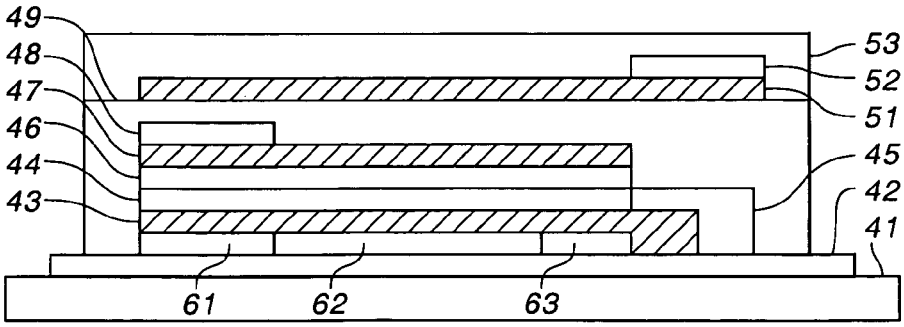
FIG. 7 is a cross-section of an EL lamp constructed in accordance with a preferred embodiment of the invention and including both cascading layers and a third electrode.

FIG. 7 is a cross-section of an EL lamp including both a color-cascading layer and a third electrode.

FIG. 8 is a table showing several combinations of materials used for making eight flexible EL lamps in accordance with the invention. Gray areas indicate that the layer was omitted. Following is the sequence of lamp layers, cross-referenced to the lamp illustrated in FIG. 7.

1. front insulator 42
2. color-cascading layers
3. front electrode 43
4. phosphor layer 44
5. dielectric layer 46
6. rear electrode 47
7. silver bus bars 45 and 48
8. middle insulator 49
9. third electrode 51
10. rear bus bar 52
11. rear insulator 53

To make a simple two-electrode lamp, like the one illustrated in FIG. 4, one omits layers 2, 8, 9, and 10. For the panel illustrated in FIG. 5, one omits layer 2. For the lamp illustrated in FIG. 7, one omits layers 8, 9, and 10. The sequence is changed according to the lamp being made.

Taking the materials in order used in the above sequence, the following examples are presented as viable, compatible materials for making an EL panel in accordance with the invention. The examples are not intended to be exhaustive of combinations or proportions. The three white formulations produce different shades of white.

Front Insulator

The preferred front insulator includes a resin solution described in U.S. Pat. No. 6,445,128 (Bush et al.), the contents of which are incorporated by reference herein. Panels made with this ink were thinner than panels made in accordance with Example 1 yet had better dimensional stability (stayed flatter) and were more elastic.

| Ingredient | Mass % |
|---|---|
| Resin Solution RS | |
| Dimethylacetamide (DMAC) | 60.0 |
| Hylar ® SN resin | 40.0 |
| Front Insulator (FI-A) | |
| Care 22 (Nazdar) | 2.40 |
| BYK ®-306 surfactant (Byk Chemie) | 7.22 |
| DMAC | 11.00 |
| RS | 79.38 |
| Red Color Cascading Layer - (UV-curable) | |
| 7600 Mixing Base (Kolorcure) | 59.8 |
| BYK ® 307 | 0.60 |
| Disperbyk ® 181 | 0.66 |
| Lunar Yellow (Swada) | 12.0 |
| Laser Red (Swada) | 13.0 |
| Flame Orange (Swada) | 14.0 |
| Green Region - (UV-curable) | |
| 7600 Mixing Base (Kolorcure) | 91.0 |
| BYK ® 307 | 0.60 |
| Disperbyk ® 181 | 0.45 |
| Lunar Yellow (Swada) | 5.37 |
| Laser Red (Swada) | 2.59 |
| White Region (1) - (UV-curable) | |
| 7600 Mixing Base (Kolorcure) | 90.0 |
| BYK ® 307 | 0.60 |
| Disperbyk ® 181 | 0.40 |
| Laser Red | 2.0 |
| Flame Orange | 7.0 |
| White Region (2) - (UV-curable) | |
| 7600 Mixing Base (Kolorcure) | 90.0 |
| BYK ® 307 | 0.60 |
| Disperbyk ® 181 | 0.40 |
| Laser Red | 3.0 |
| Flame Orange | 6.0 |
| White Region (3) - (UV-curable) | |
| 7600 Mixing Base (Kolorcure) | 90.0 |
| BYK ® 307 | 0.60 |
| Disperbyk ® 181 | 0.40 |
| Astral Pink | 6.15 |
| Laser Red | 2.38 |
| Flame Orange | 0.47 |
| Front Electrode | |
| Orgacon ™ 3040 (Agfa-Gevaert) | |
| Phosphor Layers 1, 2, 3 | |
| made with phosphors having different color emissions but the same formulae: | |
| Kyx solution | 37.1 |
| DMAC | 12.2 |
| EL Phosphor | 50.7 |

The Kyx solution used in the phosphor layer is a resin solution having the following composition.

| Ingredient | Mass % |
|---|---|
| Kyx solution | |
| DMAC | 75.63 |
| Ethylene glycol butyl ether acetate | 15.13 |
| Kynar 9301 Resin (Atofina) | 7.56 |
| Modaflow ™ (Monsanto) | 1.68 |
| Dielectric Layer | |
| Care 22 (Nazdar) | 0.45 |
| Disperbyk ® 111 modifier | 0.15 |
| Ti-Pure ® R-700 titanium dioxide | 31.2 |
| DMAC | 16.0 |
| RS | 52.2 |
| Rear Electrode | |
| Orgacon ™ 4010 (Agfa-Gevaert) | |
| Silver Bus Bars (Ag Dur) | |
| Care 22 (Nazdar) | 0.45 |
| Paraloid ™ B48N Acrylic Resin (Rohm & Haas) | 3.83 |
| DMAC | 31.73 |
| Hylar ™ SN | 7.86 |
| Silver Flake, Metz #7 | 56.13 |
| Insulator (1) - same as front insulator | |
| Insulator (2) - Kolorcure Urethane Release Coat C (UV-cured) | |
| Insulator (3) - Alternate Urethane from Kolorcure (UV-cured) | |
| Third Electrode | |
| Orgacon ® 4010 from (Agfa-Gevaert) | |
| Rear Insulator - see Insulator 1, 2, or 3 | |

The various combinations represented in FIG. 8 produced functional EL lamps, although not all of the same brightness or desired color. All of the lamps, however, were brighter than lamps made in accordance with the prior art using a polyurethane envelope and vinyl gel as the medium for the various fillers. Also, panels made in accordance with the invention did not curl when removed from the release layer. Neither did the panels delaminate.

Figure 9:
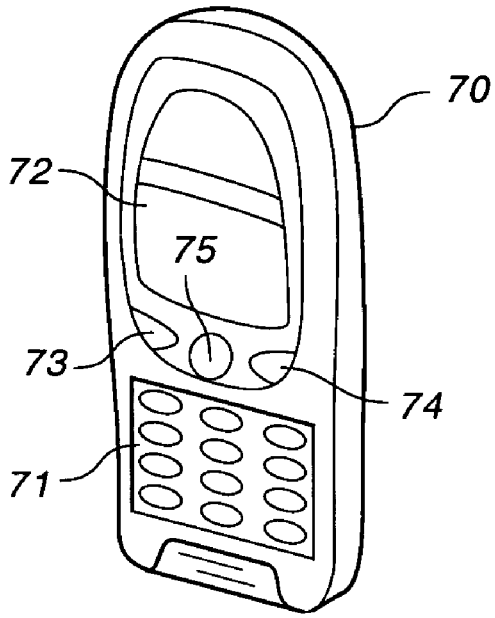
FIG. 9 is a cellular telephone having a molded cover containing an EL lamp constructed in accordance with the invention.

FIG. 9 is a perspective view of cellular telephone 70, which includes an EL panel constructed in accordance with the invention. Cellular telephone 70 has several backlit areas, such as keypad 71, LCD (liquid crystal display) 72, and function keys 73, 74, and 75. While all such areas could be backlit by a single EL panel, at least two panels are preferred, one for the LCD and one for the remaining areas. In accordance with the invention, keypad 71 is backlit by the "basic" portion of a panel, such as illustrated in FIG. 4. Function keys 73, 74, and 75 are backlit by individual lamps, corresponding to regions 61, 62 and 63 in FIG. 6. As a result, cellular telephone 70 is both attractive, due to all the colors available, and easy to use, by color coding the various keys. By virtue of its dimensional stability and flexibility, an EL panel constructed in accordance with the invention is easily molded into a cover for cellular telephone 70.

Figure 10:
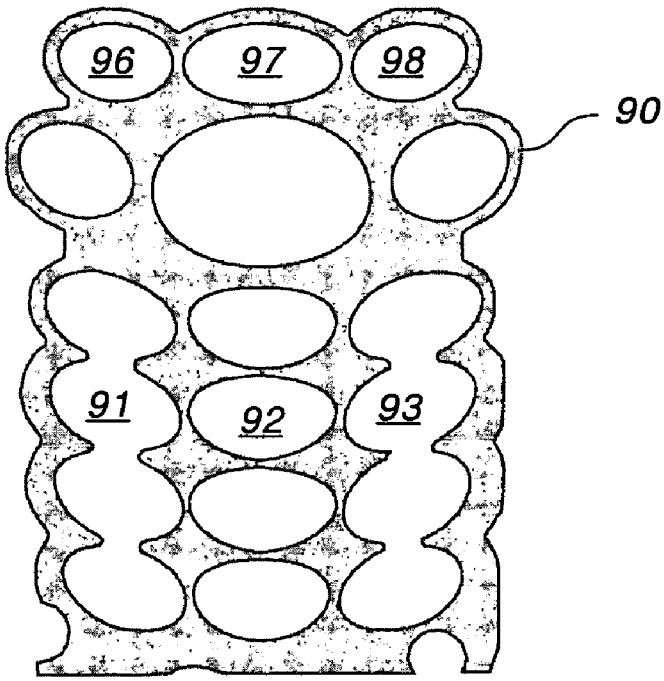
FIG. 10 is a plan view of an EL lamp constructed in accordance with a preferred embodiment of the invention.

FIG. 10 is a plan view of a panel constructed in accordance with the invention with the release layer removed. Prior to removing the release layer, panel 90 was trimmed to shape. Panel 90 includes lamps 91, 92, 93 for back lighting a keypad and includes lamps 96, 97, 98 for backlighting function keys. A single panel such as panel 90 can incorporate the constructions illustrated in FIGS. 4–7 in different areas or be constructed in accordance with a single one of FIGS. 4–7, depending upon application.

The invention thus provides a thin, thick-film, inorganic EL panel that does not curl or distort when removed from a release layer and is more stable dimensionally than urethane-based EL lamps of the prior art. The panel can be stretched and will return to its original shape when released. The panel does not require similar chemistry for adjacent lamp layers and the panel can be made from solvent based inks on a removable substrate or release layer. The resulting panel is brighter than flexible EL panels of the prior art and is well suited for keypads and other applications where non-destructive flexibility is necessary.

Having thus described the invention, it will be apparent to those of skill in the art that various modifications can be made within the scope of the invention. For example, the phosphor layer can be divided into areas for containing phosphors producing different colors instead of or in addition to the cascading layer. More than one cascading layer can be used, e.g. by including dye in the front insulating layer.

What is claimed as the invention is:

1. An electroluminescent panel comprising:
a release layer;
a first insulating layer on said release layer;
a plurality of lamp layers on said first insulating layer;
a second insulating layer overlying said lamp layers;
wherein said first insulating layer and said second insulating layer include low molecular weight PVDF/HFP resin;
wherein said lamp layers include a front electrode a front bus bar, a rear electrode, and a rear bus bar, at least one of said bus bars including low molecular weight PVDF/HFP resin and a conductive filler.

2. The electroluminescent panel as set forth in claim 1 wherein at least one of said lamp layers includes a UV-cured resin and the remaining lamp layers include a heat-cured resin.

3. The electroluminescent panel as set forth in claim 1 wherein one of said lamp layers is a cascading-color layer made from a UV-curable ink.

4. The electroluminescent panel as set forth in claim 3 wherein said first insulating layer includes a cascading dye.

5. The electroluminescent panel as set forth in claim 1 wherein said first insulating layer includes a cascading dye.

6. The electroluminescent panel as set forth in claim 1 wherein said lamp layers include a third electrode.

7. An electroluminescent panel comprising:
a release layer;
a first insulating layer on said release layer;
a plurality of lamp layers on said first insulating layer;
a second insulating layer overlying said lamp layers;
wherein at least one of said lamp layers includes a UV-cured resin and the remaining lamp layers include a heat-cured resin;
wherein said lamp layers include a front electrode, a front bus bar, a rear electrode, and a rear bus bar, at least one of said bus bars including low molecular weight PVDF/HFP resin and a conductive filler.

8. The electroluminescent panel as set forth in claim 7 wherein said first insulating layer and said second insulating layer include UV-curable resin.

9. The electroluminescent panel as set forth in claim 7 wherein at least one of said lamp layers includes low molecular weight PVDF/HFP resin.

10. The electroluminescent panel as set forth in claim 7 wherein one of said lamp layers is a cascading layer made from a UV-curable ink.

11. The electroluminescent panel as set forth in claim 10 wherein said first insulating layer includes a cascading dye.

12. The electroluminescent panel as set forth in claim 7 wherein said first insulating layer includes a cascading dye.

13. The electroluminescent panel as set forth in claim 7 wherein said lamp layers include a third electrode.

* * * * *